United States Patent [19]

Lichtblau

[11] Patent Number: 4,720,701

[45] Date of Patent: Jan. 19, 1988

[54] SYSTEM WITH ENHANCED SIGNAL DETECTION AND DISCRIMINATION WITH SATURABLE MAGNETIC MARKER

[76] Inventor: George J. Lichtblau, 23 Pin Pack Rd., Ridgefield, Conn. 06877

[21] Appl. No.: 815,823

[22] Filed: Jan. 2, 1986

[51] Int. Cl.[4] ..... G08B 13/24

[52] U.S. Cl. ..... 340/572; 330/207 R; 333/19; 340/551

[58] Field of Search ..... 340/572, 551; 330/207 R; 333/19, 176

[56] References Cited

U.S. PATENT DOCUMENTS

| | | | |
|---|---|---|---|
| 3,500,373 | 3/1970 | Minasy | 340/572 |
| 4,512,000 | 4/1985 | Masuko | 367/93 |
| 4,539,558 | 9/1985 | Fearon | 340/572 |
| 4,581,524 | 4/1986 | Hoekman et al. | 340/572 |

*Primary Examiner*—Glen R. Swann, III

*Attorney, Agent, or Firm*—Weingarten, Schurgin, Gagnebin & Hayes

[57] ABSTRACT

An antipilferage system is provided with an improved signal processing system to prevent false alarms. This signal processing involves singly or in combination the improvements of a slew rate limited amplifier, which prevents impulse noise from ringing or being stretched by subsequent filters; a gain-controlled amplifier ahead of said slew rate limited amplifier, the gain of the gain-controlled amplifier being reduced as the noise and/or signal exceeds a minimum threshold level; a video detector which controls the gain-controlled amplifier and serves to maintain a minimum signal to noise ratio; a digital smoothing circuit which averages several "frames" of the entire signal such that random noise is averaged to zero while any signals which are synchronized with the modulation are added together; signal processing circuitry for the recognition of incoming signal pulse shape as compared to a predetermined pulse shape, the output of which is a trigger signal to an alarm. Moreover, blanking is employed to block any signals from passing through the system during specific portions of the modulation period and when no "tag" signals would normally be present in the system. A dead zone elimination circuit is also disclosed along with a power-up timed inhibit circuit to prevent false alarms when the system is turned on or when severe power line transients are present.

110 Claims, 14 Drawing Figures

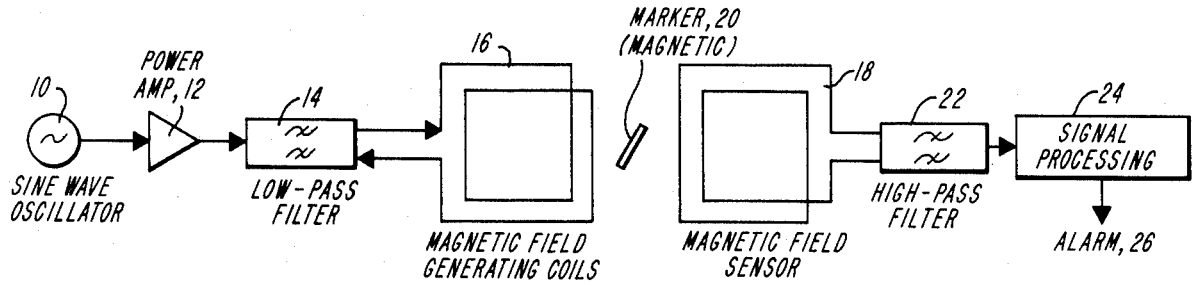
FIG. 1A
(PRIOR ART)
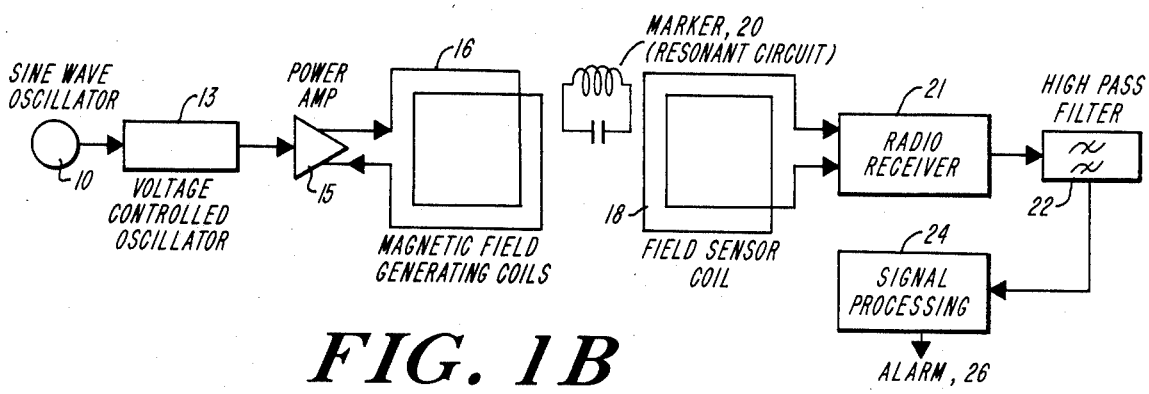
FIG. 1B
(PRIOR ART)
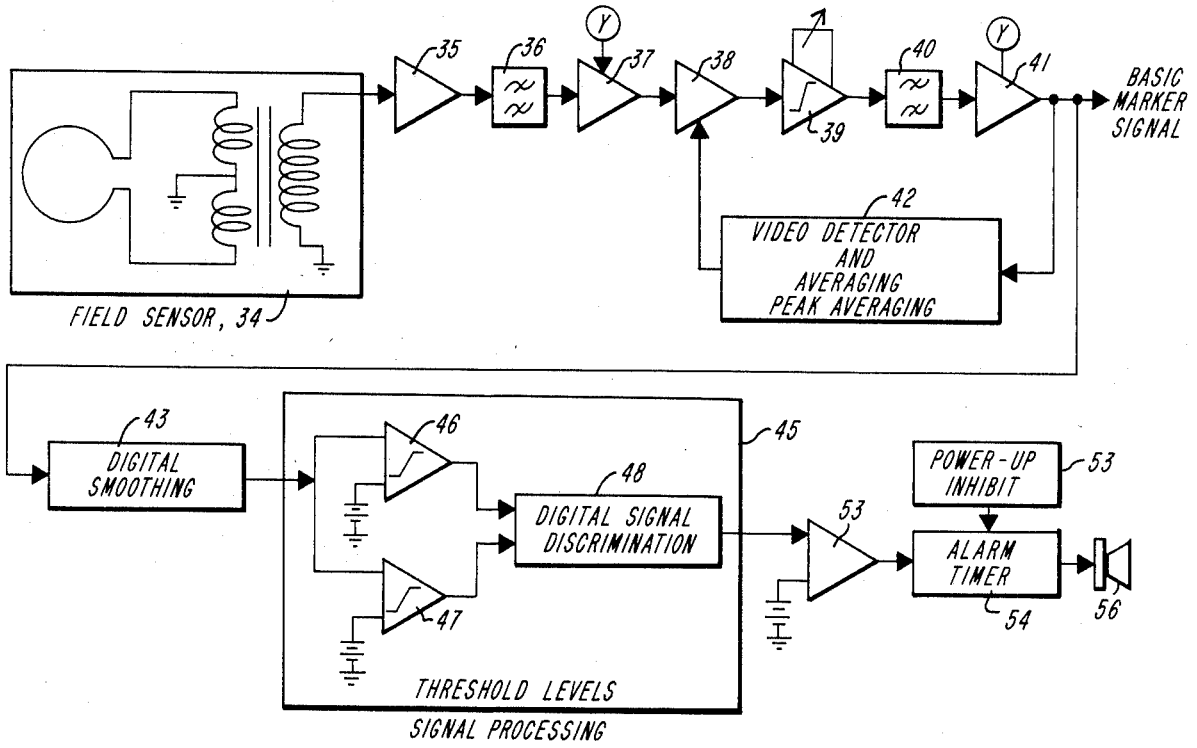
FIG. 2
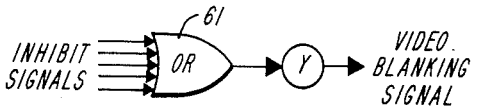

SYSTEM WITH ENHANCED SIGNAL DETECTION AND DISCRIMINATION WITH SATURABLE MAGNETIC MARKER

FIELD OF INVENTION

This invention refers to pilferage detection systems employing either a magnetic or an electromagnetic marker, and more specifically to a method and apparatus for reducing the false alarm rate of such systems.

BACKGROUND OF THE INVENTION

In the past, pilferage detection systems have been provided in which a magnetic or electromagnetic (resonant circuit) marker is placed in or on an article to be protected. If the marker is not removed or deactivated, the marker is detected by an electronic system located at the exit from the protected area.

While a great variety of antipilferage systems exist for the utilization of a magnetic or resonant circuit marker, all of the present systems have troublesome false alarms due to the high level of magnetic and electromagnetic noise in the environment. Such alarms are due to transient electromagnetic noise generated, for instance, by fluorescent lamps, the turning on and off of electrical machinery and, in general, by any unshielded electromagnetic radiation which reaches the detector portion of the system. As a result of such unwanted noise, George Lichtblau and others developed a number of filtering and signal discrimination systems to eliminate noise due to electromagnetic transients in the protected area. Representative Lichtblau systems are described in U.S. Pat. Nos. 3,810,147; 3,828,337; 3,863,244; 3,913,219; 3,938,044; 3,961,322; 3,967,161; 4,021,705; 4,117,466; 4,168,496; 4,243,980; 4,251,808; 4,260,990 and 4,498,076.

The problems associated with the utilization of a magnetic marker are, in many respects, similar to those problems associated with the utilization of a resonant circuit (radio frequency) marker. FIG. 1 1A illustrates the typical antipilferage system which uses a magnetic marker and FIG. 1B illustrates a similar system using a resonant circuit marker. In both cases, one antenna system produces an electromagnetic time varying field in the area of interest and a second antenna system monitors this field for disturbances caused by the specific type of "marker".

In both types of systems, the disturbance caused by a real marker is much shorter in time than the modulation period of the applied electromagnetic field. In the magnetic case, the field is amplitude modulated and in the resonant circuit system the radio frequency field is frequency modulated. In both cases, the basic modulation rate (and radio frequency carrier) must be removed from the monitor signal prior to further signal processing and signal discrimination.

The resonant circuit (swept radio frequency) systems are subject to problems due to spurious resonances in nearby electrical and mechanical equipment, beat-notes due to local radio transmitters and noise from fluorescent lamps, high frequency noise from nearby computers and point-of-sale case registers, and high frequency impulse noise from arcing electric motors. On the other hand, there are very few objects in retail stores which closely resemble a high "Q" resonant circuit. Magnetic based antipilferage systems are subject to many of the same type of noise sources as the resonant circuit systems. Such noise sources as arcing electric motors, point-of-sale cash registers, laser scanners, and computer printers generate large amounts of low frequency electrical noise which fall in the same frequency range as the signals produced by the magnetic markers. In addition, the magnetic based systems are constantly subject to disturbances caused by nearby magnetic materials which are present in retail stores. Supermarket checkout counters and shopping carts are almost always made of steel and other magnetic materials. The unwanted signals are not only due to the presence of magnetic materials other than the markers in the protected area, but also due to vibration of nearby magnetic materials caused, for instance, by rolling supermarket carts. The physical vibrations are then translated in spurious signals within the detection portion of the system. There have been many systems developed and patented to detect the signal produced by a resonant circuit within a swept radio frequency field. The Lichtblau earlier patents illustrate many of the problems and solutions. Likewise there have been many systems developed and patented to detect the signal produced by a magnetic marker. A very early technique was suggested in French Pat. No. 763,681 issued to P. A. Picard in 1934. Picard detected the marker by first filtering out many of the lower order harmonics of the field generating signal and then detecting a single harmonic i.e., the 13th harmonic of 50 Hertz. Picard also suggested comparing the amplitude ratio of several harmonics rather than just the amplitude of a single harmonic. Lastly he suggested that the phase of the signal produced by the magnetic marker be compared with the phase of the field producing means to aid in further discrimination.

In U.S. Pat. No. 3,631,442 issued to R. E. Fearon on Dec. 21, 1971, and U.S. Pat. No. 3,747,086 issued to G. Peterson on July 17, 1973, the magnetic field was generated using two separate frequencies and the marker served as a nonlinear mixer which gave rise to a third frequency which was the sum and difference between the two applied frequencies. The signal received by the magnetic field sensor was passed through a very narrowband filter which passed the difference (or sum) frequency.

Similar to Picard in U.S. Pat. No. 3,820,103, Fearon suggested detcting harmonics of the applied signal; however, the harmonics were detected in a synchronous detector phase-locked to the field generator so that any external noise not synchronized in frequency and phase with the magnetic field generator would be averaged out to zero.

In U.S. Pat. No. 3,665,449 issued to T. J. Elder, et al on May 23, 1972, it was recognized that the signal generated by a magnetic marker normally occurs slightly after the applied magnetic field passes through zero. Therefore, the detection system was turned on (gated) only during the portion of the modulation period when the magnetic field was near zero. In addition, the shape of the marker signal as a function of time was examined as compared to the harmonics representing the same signal.

In U.S. Pat. No. 3,983,552 issued to P. Bakeman and A. Armstrong on Sept. 28, 1976, a special magnetic marker was required and the detection system looked for only even harmonics of the applied field.

In all of the above systems, only a small part of the actual signal produced by the marker was used for signal discrimination. In addition, none of the previous systems for either resonant circuit or magnetic marker systems addressed techniques for removing high level impulse noise from the monitor systems or for automatically maintaining a minimum signal to noise ratio prior to signal discrimination.

It is quite clear that the limiting factor in sensitivity to detect a resonant circuit or magnetic marker is the relationship between the signal and the noise. If there were no noise, signal discrimination would be extremely simple. All of the previous systems looked only for the signal produced by the marker and did not examine the nature of the noise. All of the filters described in the previous patents were linear and therefore subject to high level ringing if driven by impulse type noise (automobile ignitions, etc). In addition, none of the previously described patents suggested any way to automatically adjust the sensitivity of the detection system to compensate for external noise picked up by the system.

SUMMARY OF THE INVENTION

The invention specifically deals with significantly improved means of signal processing, signal indentification and linear and nonlinear filter techniques to improve sensitivity and eliminate false alarms in antipilferage systems. The antipilferage system is provided with an improved signal processing system to prevent false alarms. The systems involves, singly or in combination, the improvements of a slew rate limited amplifier to prevent impulse noise from ringing or being stretched by subsequent filters; a gain-controlled amplifier driving the slew rate limited amplifier; a video detector and peak averaging circuit designed to preserve a predetermined minimum signal to noise ratio; a digital smoothing circuit which averages several "frames" of the entire signal such that random noise is averaged to zero, but real signals which are synchronized with the modulation are enhanced; a "tag" signal processing circuit for the recognition of incoming signal pulse shape as compared to a predetermined pulse shape, the output of which is a trigger signal. Moreover, blanking is employed to pass signals only during selected portions of the modulation period or when normal marker signals are expected to be present. A dead zone elimination system is also disclosed for "wobbling" the magnetic field (in the magnetic marker type of system).

Thus, the subject invention includes various techniques to improve sensitivity and reject noise. These techniques include nonlinear filters, recursive filters with finite memory, automatic sensitivity control based upon the type of noise picked up by the system, signal discrimination based upon the entire signal produced by the marker, and various sorts of inhibit techniques based upon the expected types of external noise which a system will pick up. Along with these techniques, signal gating and signal averaging are used.

BRIEF DESCRIPTION OF THE DRAWINGS

These and other features of the subject invention will be better understood in connection with the detailed description taken in conjunction with the drawings of which:

FIG. 1A is a schematic diagram of a typical prior art antipilferage detection system utilizing a magnetic marker;

FIG. 1B is a schematic diagram of a typical prior art antipilferage detection system utilizing a resonant circuit marker;

FIG. 2 is a schematic diagram of the the subject antipilferage low false alarm rate system for use in the system of FIG. 1A;

DETAILED DESCRIPTION

Figure 3:
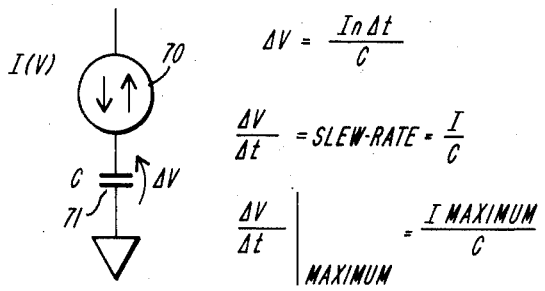
FIG. 3 is a diagram illustrating the operation of the slew rate limited amplifier of FIG. 2.

Referring now to FIG. 1A, in an antipilferage system a periodically varying magnetic field is generated by a sine wave oscillator 10 which drives a power amplifier 12 that is typically coupled to a low pass filter 14 which drives magnetic field generating coils 16 that serve as a transmitting antenna. A magnetic field sensor in the form of coils 18 detects the presence of a magnetic marker 20. The output of the magnetic field sensor is applied to a high pass filter 22 which is, in turn, applied to a signal processing unit 24 which produces an alarm signal 26 upon the detection of the presence of the magnetic marker in the vicinity of the magnetic field generating coils and the magnetic field sensor.

FIG. 1B illustrates a very similar antipilferage system using a resonant circuit marker instead of a magnetic marker. The only major difference in the principle of operation of this system is that the sine wave modulation oscillator 10 controls the frequency of a voltage-controlled-oscillator 13 and this output is amplified by a power amplifier 15 before driving the magnetic field generating coils. In addition, the field sensor coils 18 drive a radio receiver 21 which demodulates the radio frequency carrier before passing the resulting signal to the high pass filter 22.

FIG. 2 illustrates the subject signal processing system combining all of the aforementioned false alarm rejection techniques. Note that signal gating is not explicitly shown. In general, the subject system includes a magnetic or radio frequency field sensor 34 coupled to a low noise amplifier 35 which is, in turn, coupled to a high pass filter 36 the output of which is applied to a switched amplifier or video blanking amplifier 37. The output of amplifier 37 is applied to a gain-controlled amplifier 38, the output of which is applied to a slew-rate-limited amplifier 39, coupled to a low pass filter 40 which is, in turn, coupled to a switched amplifier which, in one embodiment, is a video blanking amplifier 41. The output of amplifier 41 is the basic "marker signal."

The output of amplifier 41 is fed back to a video detector and averaging circuit 42 which includes a peak averaging circuit that is, in turn, coupled to amplifier 38 to control the gain of amplifier 38 such that the gain of this amplifier is reduced upon the detection of an increased signal and/or noise component in the output amplifier 41.

The output of amplifier 41 is additionally coupled to a digital smoothing circuit 43 and then to a signal processing unit 45 which includes threshold detectors 46 and 47 fed in parallel with the signal from circuit 43. The outputs of detectors 46 and 47 are applied to a digital signal discrimination circuit 48 which compares the signals from detectors 46 and 47 to a predetermined waveform. Unit 45 is coupled to an alarm threshold amplifier 53 which is, in turn, coupled to an alarm timer 54 that is further gated by a power-up and transient-power inhibit circuit 55. The output of the alarm timer is coupled to a loud speaker 56 or other enunciation-type device.

Provision is made within the circuit of FIG. 2 to allow various types of inhibit signals to "blank" the video signal. All such inhibit signals are applied to a multiple input OR gate prior to generating the "blanking" signal for the video channel. One such external inhibit signal would prevent the system from alarming until a person is approaching or within the antipilferage system detection region. Another inhibit signal would inhibit the video signal except when the field modulation is within prescribed limits. A third such inhibit signal would "blank" out extremely high level noise spikes.

The operation of each of the components of the system described above and in FIG. 2 will now be set forth.

As is common to all of the antipilferage marker detection systems, a field sensor picks up the marker signal as well as noise. This is amplified by a low noise amplifier and passed through a high-pass filter to remove the lower order harmonics and other low frequency signals which are produced by the system or external noise. Since the marker signal is quite short in time compared to the applied field, almost all of the marker signal will pass through the high-pass filter. The signal then is further amplified by amplifiers 37 and 38 until it reaches amplifier 39. This is a special nonlinear amplifier which is designed to be slew rate limited.

The most common form of external noise is implulse noise. This noise is characterized by a very high amplitude with a very short duration. This type of signal passes through high-pass filters with almost no attentuation However, when impulse noise enters a low-pass filter, such as low-pass filter 40, it is stretched out in time by the filter. Thus, high amplitude, short duration noise is turned into relatively low amplitude, long duration noise. Frequently, the amplitude of the impulse noise is so great, that even after passing through the low-pass filter, the amplitude is sufficient to saturate the next amplifier, e.g., amplifier 41. However, inpulse noise is also characterized in that the rate of rise of the voltage (volts/second) is very large compared to any signal generated by the marker. Therefore, it is possible to discriminate between the marker signal and impulse noise by the rate-of-change of the signal as defined in volts/second.

Amplifier 39 is designed to limit the output signal to a maximum rate of change (volts/second), but does not limit the actual maximum amplitude of its output signal. This amplifier permits a slowly varying signal to have a large output amplitude, but limits a rapidly varying signal to a small amplitude. The design of the amplifier does not cause ringing and does not stretch out high level impulse type noise.

FIG. 3 illustrates the operation of the slew rate limited amplifier shown as 39 in FIG. 2. In FIG. 3 amplifier 39 is represented as a current source 70 with the current output linearly related to the voltage input. However, the current is limited to a maximum current (Imax) in all cases. The current charges and discharges a capacitor 71 and the voltage across the capacitor represents the output of the slew rate limited amplifier. The slew rate is defined as the rate of change of voltage with respect to time. For the case of a current charging a capacitor, the equations in FIG. 3 show that the maximum slew rate is defined by the ratio of the maximum current and the size of the capacitor.

Figure 4:
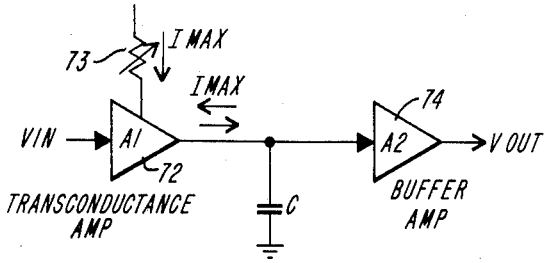
FIG. 4 is a schematic diagram illustrating one embodiment of the slew rate limited amplifier of FIG. 2.

FIG. 4 illustrates one implementation of the slew rate limited amplifier. The current source is generated by a standard transconductance amplifier 72, wherein the output current is proportional to the input voltage. The maximum output current is set by a resistor or potentiometer 73. In this figure, the output of amplifier 72 is coupled to a buffer amplifier 74. Selection of capacitor 71 and the maximum output current, determine the maximum slew rate of the amplifier. The voltage across the capacitor goes to a very high input impedance amplifier, so that current leakage from the capacitor to ground will not distort the output signal.

Figure 5:
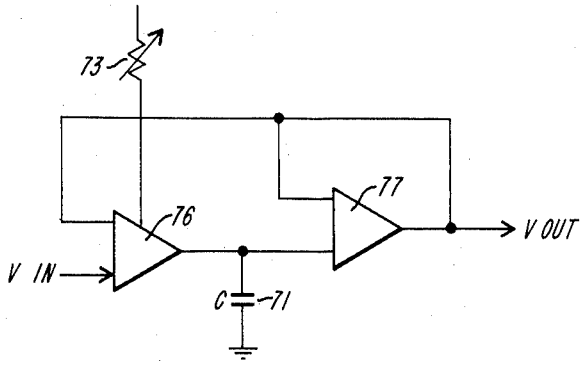
FIG. 5 is a schematic diagram of a further embodiment of the slew rate limited amplifier of FIG. 2.

In one embodiment, the slew rate limited amplifier is constructed as shown in FIG. 5 wherein the capacitor 71 is placed inside the feedback loop of two operational amplifiers 76 and 77 set for unity gain. Normally, the system is operated with capacitor 71 removed and the actuatl maximum slew rate of the marker signal is measured. Then capacitor 71 is selected and the maximum current adjusted via potentiometer 73 to allow the marker signal to pass but to slew rate limit impulse noise.

It is important that the slew rate limited amplifier 39 be placed before the first major low-pass filter 40 and before the signal is amplified greatly as by amplifier 41. The slew rate limited amplifier prevents impulse noise from "ringing" or being stretched by the low-pass filter and prevents saturation of the final amplifier by the high level impulse noise.

FIG. 2 also illustrates a technique in which the detection system automatically adjusts its sensitivity according to the level and type of noise that is picked up by the magnetic field sensor. As shown in FIG. 2, the signal from the sensor passes through amplifier 35, high-pass filter 36, and amplifiers 37, 38 and slew rate limited amplifier 39. It then passes through the system low-pass filter 40 and on to the final signal amplifier 41. The signal from amplifier 41 is the basic analog signal used in the system. If digital filtering which performs a smoothing function is used, then the final signal comes from the output of the digital smoothing circuit 43. All further signal processing is based upon the amplitude and shape of this signal as compared to the noise. If the noise becomes too great, either the system may false alarm or the signal will become distorted by the noise and will be unable to be detected. Therefore, it is important for good signal detection and discrimination that the minimum signal-to-noise ratio at this point be fixed.

The signal-to-noise ratio at the output of amplifier 41 is fixed by sampling the output with a special type of noise detector 42 and controlling the total gain of the system based upon the noise at the output of amplifier 41. Thus, the noise, or signal plus noise, is fed from amplifier 41 into the special video detector 42 which functions as a noise detector. The output of this detector then controls the gain of amplifier 38, a voltage-controlled amplifier, in a manner to maintain the output signal-to-noise ratio above a minimum level.

Figure 6A:
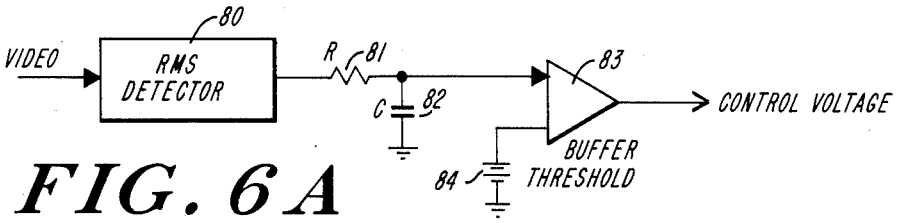
FIGS. 6A, B and C are block diagrams illustrating in schematic form several embodiments of the noise detector of FIG. 2.
Figure 6B:
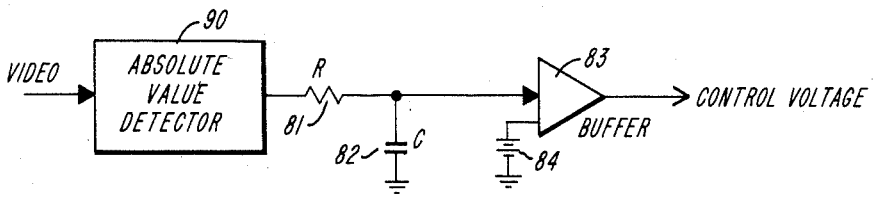
Figure 6C:
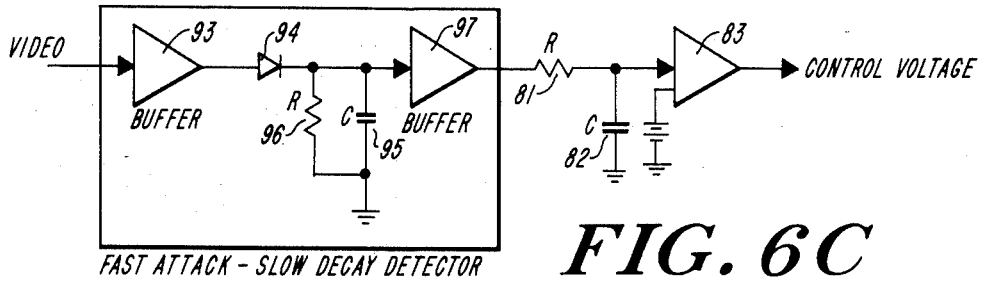

FIGS. 6A–C illustrate several embodiments for noise detector 42. In FIG. 6A, the output of amplifier 41 is converted by a true RMS (root mean square) circuit 80 into a DC voltage proportional to the root-mean-square of the noise input. The DC voltage is averaged by a simple low-pass filter comprising resistor 81 and capacitor 82, is buffered by amplifier 83 and is used to control the overall gain of the system. In this embodiment, the output of averaging circuit 42 is compared to a threshold level established by voltage source 84 before the gain of amplifier 38 is reduced. The setting of the threshold level by voltage source 84 reprsents the minimum acceptable signal-to-noise ratio for the system. The true RMS detector is most useful when the majority of the input noise is purely random.

FIG. 6B shows the same detector; however, the RMS circuit has been replaced with an absolute value detector 90. In this case the input noise is fullwave rectified, and then averaged before being compared to the threshold level. This circuit is most useful when there is a constant level of repetitive type noise coming into the system.

FIG. 6C illustrates another type of noise detector which is a fast-attack, slow-decay detector 92. In this case the peak noise at buffer 93 is rectified at diode 94 and is stored on a capacitor 95. The capacitor can be rapidly charged but is only allowed to discharge slowly via resistor 96. The output is buffered by buffer 97. This type of detector is most useful when digital smoothing circuit 43 is also employed in the system. When digital smoothing is employed, it is almost impossible to alarm the system on anything else than a real marker. However, high level noise can still distort the marker signal and prevent detection. The fast-attack-slow-decay detector responds rapidly to the peak signal supplied by the marker. If the signal exceeds the threshold level of the automatic gain control system, then, as the marker signal increases, the overall gain decreases. This maintains the marker signal at a level sufficient for accurate detection while the noise is reduced in porportion to the size of the marker signal. In other words, the marker signal increases to a maximum level set by the automatic gain control system. At this point the marker signal remains constant in amplitude while the noise is automatically decreased. This is the optimum condition for signal detection when digital smoothing is used in the system.

Another optional, although very effective, signal processing technique used to enhance the signal-to-noise ratio in marker systems is called "smoothing." The basic concept is to average several complete "frames" of signal, where one frame represents the total signal received during one period of the field modulation. One complete "frame" represents the total signal received by the system during the time that the modulation changes from its minimum to its maximum level and then back to its minimum level. In a magnetic system this is the time for the magnetic field to change from its largest negative value to its largest positive value and then back to its largest negative value. In a swept radio frequency (resonant circuit marker) system, this is the time for the radio frequency carrier to change from its minimum to its maximum frequency and then back to its minimum frequency. This is called the period of the modulation. Smoothing takes the information from many periods and combines these in a mathematical manner so that random noise is averaged to zero at time=infinity, and any signals which are synchronized with the modulation are added together.

Figure 7A:
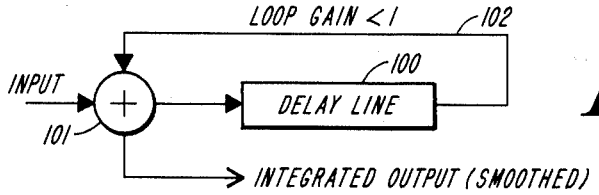
FIGS. 7A and B are block diagrams illustrating two embodiments of smoothing circuits for use in the system of FIG. 2.

One very effective form of smoothing is shown in FIG. 7A and is known as a delay line integrator. In this case the time of a delay line 100 must be exactly equal to the period of the modulation. A portion of the input signal is added at 101 in phase with part of the signal from the previous modulation period via feedback 102. This delay line filter averages a series of repetitive signals and substantially reduces the system response to any noise which is not synchronized with the magnetic modulation. The choice of the amount of positive feedback from the output of the delay line is always a compromise between the speed of response of the system and the amount of filtering or smoothing to reduce the noise and enhance the signal. The output of the delay line integrator to a unity step input is shown in the equations at the bottom of FIG. 7B. The number "N" is the design parameter which affects smoothing versus speed of response.

Figure 7B:
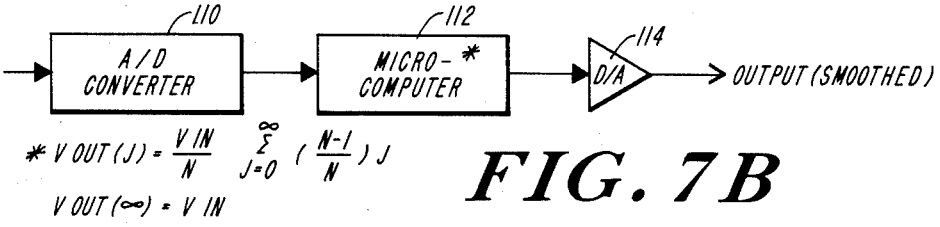

FIG. 7B indicates another method of performing the smoothing operation. In this case the analog signal from amplifier 41 is converted to digital form by an analog-to-digital converter 100. Then a microcomputer 112 performs the mathematic operations indicated by the equations in the lower portion of FIG. 7B. Finally, the digital output is converted back to analog form by D/A converter 114 for use in subsequent signal processing. It should be noted that this computation is also a sampled data operation. Therefore, the microcomputer must be synchronized with the modulation by a clock generator.

Figure 8:
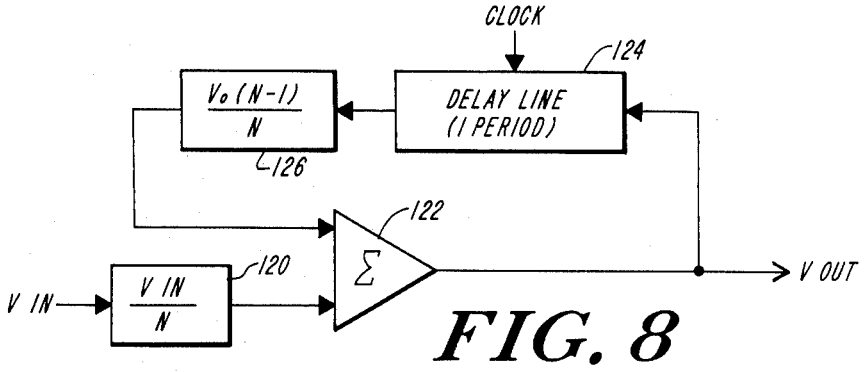
FIG. 8 is a block diagram illustrating a more efficient technique to implement the delay line integrator shown in FIG. 7.

Referring back to FIG. 7A, because very long analog delay lines are both large and very expensive, a more effective technique to implement the delay line integrator is shown in FIG. 8. The signal from amplifier 41 is attentuated at 120 by a factor of "N". This is fed into one port of a summer 122. The output of the sumemr is fed to the input of a charge-coupled bucket brigade delay line 124. The clock input to the delay line is set so that the period of the delay is exactly equal to one period of the modulation. The output of the delay line is attenuated by a factor of $(N-1)/N$ by circuit 126 and is fed back to the input of the summer in phase with the original signal.

Since the bucket brigade delay line is a sampled data system, the sample rate set by the clock must be at least two times the maximum frequency of interest in the system. In addition, the total delay through the delay line must be exactly equal to the period of the modulation.

Figure 9:
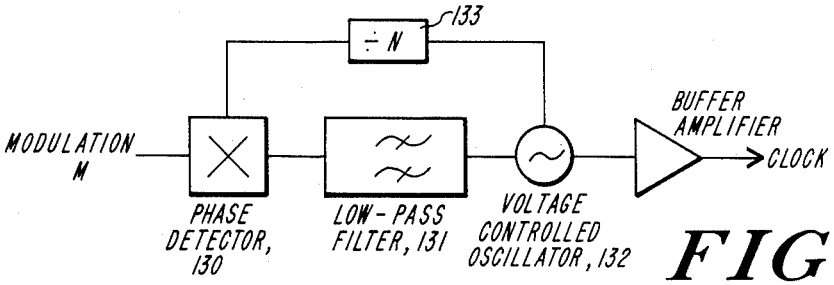
FIG. 9 is a block diagram illustrating the generation of a clock signal for use as the clock input to the delay line integrator of FIG. 8.

Both of these requirements can be satisfied simultaneously by generating the clock in the manner shown in FIG. 9. The modulation (fm) is fed into one port of a phase detector 130 which is part of a phase-locked loop frequency synthesizer. The output frequency of the synthesizer which includes a low-pass filter 131, a voltage-controller oscillator 132 and a divide-by-N circuit 133 is set to be "N" times the input frequency by means of the divide-by-N counter in the feedback loop. The value of "N" and the type of delay line must be chosen to meet the Nyquist criterion for sampled data systems and the delay line integrator requirement simultaneously.

So far the signal processing functions indicated in FIG. 2 have all served to enhance the signal-to-noise ratio of the marker signal. Processor 45 in FIG. 2 serves to pick out the unique signal generated by a magnetic marker, as compared to all the other types of signals picked up by the system.

As shown in FIG. 2, the output of the digital smoothing circuit 43, if it is used, is applied to two threshold detectors 46 and 47 operating in parallel, a positive threshold detector and a negative threshold detector. The marker signal is programmed into the signal discrimination unit for recognition and the incoming signals are compared in rear time, with the representation stored in the signal discrimination system. The marker signal is approximated by a series of positive and negative pulses of fixed minimum amplitude, each pulse having a pulse width defined as falling between a minimum and maximum value. The total marker signal is presented by a series of positive and negative pulses which occur in a predetermined time sequence. Each incoming pulse is compared with the stored representation of that pulse. If the first input pulse meets the acceptance criterion, then the second pulse recognition system is enabled. If the next pulse that arrives meets the recognition criterion for the second, pulse, then the third pulse recognition system is enabled. This continues until the entire signal is recognized or until there is a mismatch between the input signal and the marker signal criterion. At this point the entire recognition process is reset to look for the first pulse again.

By predefining the expected marker signal in terms of a series of positive and negative pulses with minimum amplitudes and minimum and maximum pulse widths, extremely accurate signal recognition can be made. If a microcomputer is used for the signal recognition task, then it is quite simple to program the recognition system to have different amplitudes as well as pulse widths for each portion of the marker signal.

When an input signal meets the criteria programmed into the signal recognition system, the signal recognition system generates an output trigger pulse. As shown in FIG. 2, this trigger pulse normally starts an alarm timer 54 which controls an audio or visual alarm.

FIG. 2 also illustrates provision for "blanking" the field sensor signal by means of gating signals controlling amplifiers 37 and 41. That is, the amplifier gain may be rapidly reduced to a very low level by means of an external gating signal. This is provided by the output of OR gate 61. This OR gate has provision for multiple inputs so that various sources of this "blanking" signal may be used in the system.

As shown in FIG. 2, amplifiers 37 and 41 have provision for "blanking"; that is, the amplifier gain may be reduced to a very low level by means of an external signal. This signal is provided by the output of OR gate 61. Other sources of external inhibit signals can be provided via OR gate 61, such as hard-wired inhibit signals and inhibit signals via fiber optic or other transmission lines.

For example, in supermarkets, many of the aisles are not in operation and people are not permitted to pass through these inactive aisles. An electric eye or heat sensor can be used to detect the approach of a person to each active aisle and turn the detection system on for a period of time sufficient for the average person to pass through the detection system. In this manner, inactive aisles are automatically turned off and there is no change of false alarms.

From the above discussion, it will be obvious that the successful design of an antipilferage marker detection system depends on not only detecting the marker but designing the system based upon the human and expected environmental noise found in the rear world. One method to further reduce the noise picked up by the system and enhance the signal detection is to improve upon the field generating and sensing antennas. A copending patent application, Ser. No. 680,165, filed Jan. 10, 1985, entitled "Antenna System for Resonant Circuit and Magnetic Detection Systems" illustrates an extremely effective design of an antenna for these systems.

If the field generating and field sensing antennas are designed according to the principles disclosed in the copending patent application, then it is also possible to automatically rotate the magnetic field slightly even through the antennas are built in a single plane.

Figure 10:
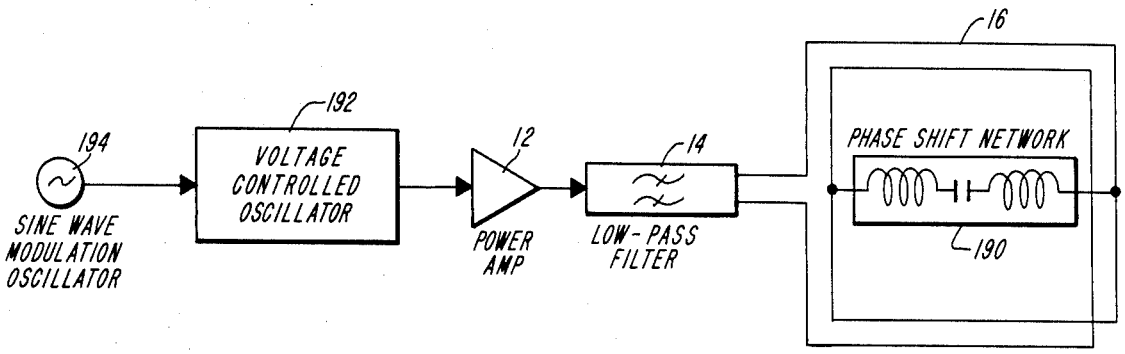
FIG. 10 is a block diagram illustrating an L-R-C network properly selected and placed at the crossover points in the magnetic field field generating coils of the system of FIG. 1A such that if the magnetic modulation frequency is modulated, then the magnetic field can be "wobbled" and "dead" zones in the magnetic field are subsequently reduced.

FIG. 10 illustrates that, if an L-R-C network 190 is properly selected and placed at the crossover points in antenna 16 and if the magnetic modulation is frequency modulated, then the magnetic field can be "wobbled" and "dead" zones in the magnetic field substantially reduced. As shown in FIG. 10, a voltage-controlled oscillator 192 provides the basic magnetic field, and this frequency is modulated by a sine wave oscillator 194. The resultant phase shift in different parts of the antenna causes the magnetic field vectors to wobble as the frequency is varied.

The invention is for use in an antipilferage system wherein a magnetic or radio frequency field is generated in a specific area. Tthe field is amplitude modulated and/or frequency modulated and is monitored for changes by another field sensor. When a marker is placed in the vicinity of the field, a detectable signal is produced in the field monitor.

Having above indicated a preferred embodiment of the present invention, it will occur to those skilled in the art that modification and alternative can be practiced within the spirit of the invention. It is accordingly intended to define the scope of the invention only as indicated in the following claims:

What is claimed is:

1. Apparatus for detecting the presence of an object within an interrogation zone comprising:

a marker adapted to be secured to said object;

means for applying in said interrogation zone an electomagnetic field having a periodic waveform;

means for monitoring said field in the vicinity of said interrogation zone and detecting disturbances to said field due to the interaction of said marker with said field so as to produce a monitor signal including pulses and noise;

means for removing from said monitor signal substantially all frequency components in the vicinity of the frequency of said periodic waveform of said applied field;

means for detecting pulses in the remaining frequency components of said monitor signal;

signal discrimination and noise rejection means receiving said detected pulses for determining is said detected pulses were caused by said marker and, if so, to produce an alarm indication signal;

said signal discrimination and noise rejection means including a slew rate limited amplifier, the maximum rate of change of voltage with respect to time of the output of said amplifier being limited to be less than a predetermined value; and means operative in response to production of said alarm indication signal for indicating the presence of said marker within said interrogation zone.

2. The apparatus of claim 1 and further including a linear low-pass filter receiving the output signal of said slew rate limited amplifier.

3. The apparatus of claim 1 and further including means for generating a gain control signal, an amplifier, means for passing said pulses through said amplifier, and means for varying the gain of said amplifier in response to said gain control signal.

4. The apparatus of claim 3 wherein the gain of said amplifier is controlled by a signal which is proportional to the true root-mean-square (RMS) of the detected pulses and the noise.

5. The apparatus claim 3 wherein the gain of said amplifier is controlled by a signal which is proportional to the average absolute value of the detected pulses and the noise.

6. The apparatus of claim 3 wherein the gain of said amplifier is controlled by a signal which is proportional to the peak value of the detected pulses and noise.

7. The apparatus of claim 3 wherein the gain of said amplifier is controlled by a signal which is proportional to the peak value of the detected pulses and noise and responds very rapidly to such peak but decays slowly to a previously low level, thereby to provide a fast-attack-slow-decay response.

8. The apparatus of claim 1 and further including a gain-controlled amplifier for amplifying said pulses and means for rapidly switching the gain of said amplifier from full gain to a very low gain.

9. The apparatus of claim 1 and further including a variable gain-controlled amplifier coupled to said slew rate limited amplifier.

10. The apparatus of claim 1 and further including means for periodically converting said detected pulses and noise from an analog to a digital representation before further signal processing.

11. The apparatus of claim 10 wherein said said signal discrimination means includes means for synchronizing the timing of the analog to digital conversion with the periodic waveform of the applied field.

12. The apparatus of claim 11 wherein said synchronizing means includes a phase-locked-loop.

13. The apparatus of claim 1 wherein said signal discrimination means includes means for providing a representation of the expected signal produced by the marker, and a memory for storing said representation.

14. The apparatus of claim 13 where said memory is a digital memory.

15. The apparatus of claim 13 wherein said memory includes one or more threshold detectors and minimum pulse width detectors.

16. The apparatus of claim 1 wherein said signal discrimination means includes means for providing a representation of the expected signal produced by the marker, a memory means for storing said representation and further including means for comparing the detected pulses with the representation in said memory to discriminate the expected marker signal from noise.

17. The apparatus of claim 1 wherein the marker is a magnetic marker and the applied field has sufficient magnetic force to cause magnetic changes in said magnetic marker.

18. The apparatus of claim 17 wherein said magnetic marker includes a strip having a length at least ten times the maximum dimensions of the cross-sectional area.

19. The apparatus of claim 17 and further including a linear low-pass filter receiving said pulses from the output of the said slew rate limited amplifier.

20. The apparatus of claim 17 and further including means for generating a gain control signal, and amplifier receiving said pulses, and means for varying the gain of said amplifier in response to said gain control signal.

21. The apparatus of claim 20 wherein the gain of said amplifier is controlled by a signal which is proportional to the true root-means-square (RMS) of the detected pulses and the noise.

22. The apparatus of claim 20 wherein the gain of said amplifier is controlled by a signal which is proportional to the average absolute value of the detected pulses and the noise.

23. The apparatus of claim 20 wherein the gain of said amplifier is controlled by a signal which is proportional to the peak value of the detected pulses and noise.

24. The apparatus of claim 20 wherein the gain of said amplifier is controlled by a signal which is proportional to the peak value of the detected pulses and noise and responds very rapidly to such peak but decays slowly to a previously low level, thereby to provide a fast-attach-slow-decay response.

25. The apparatus of claim 17 and further including a gain-controlled amplifier for amplifying said pulses and means for rapidly switching the gain of said amplifier from full gain to a very low gain.

26. The apparatus of claim 17 and further including a variable gain-controlled amplifier coupled to said slew rate limited amplifier.

27. The apparatus of claim 17 and further including means for periodically converting said detected pulses and noise from an analog to a digital representation before further signal processing.

28. The apparatus of claim 27 wherein said signal discrimination means includes means for synchronizing the timing of the analog to digital conversion with the periodic waveform of the applied field.

29. The apparatus of claim 28 wherein said synchronizing means includes a phase-locked-loop.

30. The apparatus of claim 17 wherein said signal discrimination means includes means for providing a representation of the expected signal produced by the marker, a memory, and storing said representation in said memory.

31. The apparatus of claim 30 where said memory is a digital memory.

32. The apparatus of claim 30 wherein said memory includes one or more threshold detectors and minimum pulse width detectors.

33. The apparatus of claim 17 wherein said signal discrimination means includes means for providing a representation of the expected signal produced by the marker, a memory means for storing said representation in said memory; further including means for comparing the detected pulses with the representation in said memory to discriminate the expected marker signal from noise.

34. The apparatus of claim 17 wherein said field is alternating and wherein said detected pulses and noise are passed through a recirculating delay line integrator with the delay time of the delay line equal to the period of the alternating applied magnetic field.

35. The apparatus of claim 34 wherein said delay line includes a charge coupled device (CCD).

36. The apparatus of claim 34 wherein said recirculating delay line is synchronized to the applied magnetic field.

37. The apparatus of claim 36 and further including a phase-locked-loop synchronization of said recirculating delay line to the applied magnetic field.

38. The apparatus of claim 17 and further including means for periodically converting said detected pulses and noise from an analog to a digital representation before further signal processing.

39. The apparatus of claim 38 wherein said signal discrimination includes means for synchronizing the timing of the analog to digital conversion with the periodic waveform of the applied magnetic field.

40. The apparatus of claim 39 wherein said synchronizing means includes a phase-locked-loop.

41. The apparatus of claim 17 and further including means for inhibiting said apparatus from indicating the presence of said magnetic marker for a fixed period of time after power is turned on to said apparatus.

42. The apparatus of claim 1 wherein the marker is a resonant circuit and the applied electromagnetic field is at a freqeuncy which is swept through a range including the resonant frequency of the marker.

43. The apparatus of claim 42 and further including a linear low-pass filter receiving said pulses from the output of said slew rate limited amplifier and then through said linear low-pass filter.

44. The apparatus of claim 42 and further including means for generating a gain control signal, an amplifier receiving said pulses, and means for varying the gain of said amplifier in response to said separate gain control signal.

45. The apparatus of claim 44 wherein the gain of said amplifier is controlled by a signal which is proportional to the true root-mean-square (RMS) of the detected pulses and the noise.

46. The apparatus of claim 44 wherein the gain of said amplifier is controlled by a signal which is proportional to the average absolute value of the detected pulses and the noise.

47. The apparatus of claim 44 wherein the gain of said amplifier is controlled by a signal which is proportional to the peak value of the detected pulses and noise.

48. The apparatus of claim 44 wherein the gain of said amplifier is controlled by a signal which is proportional to the peak value of the detected pulses and noise and responds very rapidly to such peak but decays slowly to a previously low level, thereby to provide a fast-attack-slow-decay response.

49. The apparatus of claim 42 and further including a gain-controlled amplifier for amplifying said pulses and means for rapidly switching the gain of said amplifier from full gain to a very low gain.

50. The apparatus of claim 42 and further including a variable gain controlled amplifier coupled to said slew rate limited amplifier.

51. The apparatus of claim 42 and further including means for periodically converting said detected pulses and noise from an analog to a digital representation before further signal processing.

52. The apparatus of claim 51 wherein said signal discrimination means includes means for synchronizing the timing of the analog to digital conversion with the modulation of the swept radio frequency field.

53. The apparatus of claim 52 wherein said synchronizing means includes a phase-locked-loop.

54. The apparatus of claim 42 wherein said signal discrimination means includes means for providing a representation of the expected signal produced by the marker, a memory, and storing said representation in said memory.

55. The apparatus of claim 54 where said memory is a digital memory.

56. The apparatus of claim 54 wherein said memory includes one or more threshold detectors and minimum pulse width detectors.

57. The apparatus of claim 42 wherein said signal discrimination means includes means for providing a representation of the expected signal produced by the marker, a memory means for storing said representation in said memory; further including means for comparing the detected pulses with the representation in said memory to discriminate the expected marker signal from noise.

58. Apparatus for detecting the presence of an object within an interrogation zone comprising:

a marker adapted to be secured to said object;

means for applying in said interrogation zone an electromagnetic field having a periodic waveform;

means for monitoring said field in the vicinity of said interrogation zone and detecting disturbances to said field due to the interaction of said marker with said field so as to produce a monitor signal including pulses and noise;

means for removing from said monitor signal substantially all frequency components in the vicinity of the frequency of said periodic waveform of said applied field;

means for detecting pulses in the remaining frequency components of said monitor signal;

receiving said pulses for determining if said detected pulses were caused by said marker and, if so, to produce an alarm indication signal;

said signal discrimination and noise rejection means storing in a digital memory a representation of the signal expected when said member is present in said interrogation zone, said representation comprising a predetermined series of alternating polarity pulses which occur in a predetermined time sequence wherein each of said pulses is approximated by a rectangular voltage waveform with a predetermined minimum amplitude and with a pulse width defined as falling between a predefined minimum and maximum value, and comparing the detected pulses from said monitor to the representation in memory to discriminate the expected marker signal from noise; and means operative in response to the production of said alarm indication signal for indicating the presence of said marker within said interrogation zone.

59. The apparatus of claim 58 and further including means for generating a gain control signal, an amplifier receiving said monitor pulses, and means for varying the gain of said amplifier in response to said gain control signal.

60. The apparatus of claim 59 wherein the gain of said amplifier is controlled by a signal which is proportional to the true root-mean-square (RMS) of the detected pulses and noise.

61. The apparatus of claim 59 wherein the gain of said amplifier is controlled by a signal which is proportional to the average absolute value of the detected pulses and noise.

62. The apparatus of claim 59 wherein the gain of said amplifier is controlled by a signal which is proportional to the peak value of the detected pulses and noise.

63. The apparatus of claim 59 wherein the gain of said amplifier is controlled by a signal which is proportional to the peak value of the detected pulses and noise and responds rapidly to such peaks but decays slowly to a previously low level, thereby to provide a "fast-attach-slow-decay" response.

64. The apparatus of claim 58 and further including means for periodically converting said detected pulses and noise from an analog to a digital representation before further signal processing.

65. The apparatus of claim 64 further including means for synchronizing said analog to digital conversion to the periodic waveform of the applied field.

66. The apparatus of claim 65 wherein said means for synchronizing includes a phase-locked loop.

67. The apparatus of claim 58 wherein the marker is a magnetic marker and the applied field has sufficient magnetic force to cause magnetic changes in said magnetic marker.

68. The apparatus of claim 67 and further including means for generating a gain control signal, an amplifier receiving said monitor pulses, and means for varying the gain of said amplifier in response to said gain control signal. .

69. The apparatus of claim 68 wherein the gain of said amplifier is controlled by a signal which is proportional to the true root-mean-square (RMS) of the detected pulses and noise.

70. The apparatus of claim 68 wherein the gain of said amplifier is controlled by a signal which is proportional to the average absolute value of the detected pulses and noise.

71. The apparatus of claim 68 wherein the gain of said amplifier is controlled by a signal which is proportional to the peak value of the detected pulses and noise.

72. The apparatus of claim 68 wherein the gain of said amplifier is controlled by a signal which is proportional to the peak value of the detected pulses and noise and responds rapidly to such peaks but decays slowly to a previously low level, thereby to provide a "fast-attack-slow-decay" response.

73. The apparatus of claim 67 and further including means for periodically converting said detected pulses and noise from an analog to a digital representation before signal processing.

74. The apparatus of claim 73 wherein said analog to digital conversion is synchronized with the periodic waveform of the applied field.

75. The apparatus of claim 74 wherein said synchronizing means includes a phase-locked loop.

76. The apparatus of claim 58 wherein the marker is a resonant circuit and the applied electromagnetic field is at a frequency which is swept through a range including the resonant frequency of the marker.

77. The apparatus of claim 76 and further including means for generating a gain control signal, an amplifier receiving said monitor pulses, and means for varying the gain of said amplifier in response to said gain control signal.

78. The apparatus of claim 77 wherein the gain of said amplifier is controlled by a signal which is proportional to the true root-mean-square (RMS) of the detected pulses and noise.

79. The apparatus of claim 77 wherein the gain of said amplifier is controlled by a signal which is proportional to the average absolute value of the detected pulses and noise.

80. The apparatus claim 77 wherein the gain of said amplifier is controlled by a signal which is proportional to the peak value of the detected pulses and noise.

81. The apparatus of claim 77 wherein the gain of said amplifier is controlled by a signal which is proportional to the peak value of the detected pulses and noise and responds rapidly to such peaks but decays slowly to a previously low level, thereby to provide a "fast-attack-slow-decay" response.

82. The apparatus of claim 76 and further including means for periodically converting said detected pulses and noise from an analog to a digital representation before further signal processing.

83. The apparatus of claim 82 further including means for synchronizing said analog to digital conversion to the modulation of the swept radio frequency field.

84. The apparatus of claim 83 wherein said means for synchronizing includes a phase-locked loop.

85. The apparatus of claim 58 and further including a recirculating delay line integrator wherein said signals from said monitor are passed through said integrator prior to comparison with said digital representation of said monitor signal.

86. The apparatus of claim 85 wherein said delay line integrator is synchronized with the periodic waveform of the applied field.

87. The apparatus of claim 85 wherein said delay line integrator is implemented in a charge-coupled delay line.

88. The apparatus of claim 85 wherein said delay line integrator is implemented in a digital memory in conjunction with a microprocessor.

89. Apparatus for detecting the presence of an object within an interrogation zone comprising:

a marker adapted to be secured to said object;

means for applying in said interrogation zone an electromagnetic field having a periodic waveform;

means for monitoring said field in the vicinity of said interrogation zone and detecting disturbances to said field due to the interaction of said marker with said field so as to produce a monitor signal including pulses and noise;

means for removing from said monitor signal substantially all frequency components in the vicinity of the frequency of said periodic waveform of said applied field;

means for detecting pulses in the remaining frequency components of said monitor signals;

signal discrimination and noise rejection means for receiving said detected pulses for determining if said detected pulss were caused by said marker and, if so, to produce an alarm indication signal;

means for generating a gain control signal, an amplifier, means for passing said monitor pulses through said amplifier, and means for varying the gain of said amplifier in response to said gain control signal, wherein the gain of said amplifier is controlled by a signal which is proportional to the peak value of the detected pulses and noise adn responds rapidly to such peaks, but decays slowly to a previously low level, providing a fast-attack-slow-decay response; and means operative in response to production of said alarm indication signal for indicating the presence of said marker within said interrogation zone.

90. The apparatus of claim 89 and further including means for periodically converting said detected pulses and noise from an analog to a digital representation before signal processing.

91. The apparatus of claim 90 wherein said analog ot digital conversion is synchronized with the periodic waveform of the applied field.

92. The apparatus of claim 91 wherein said synchronizing means includes a phase-locked loop.

93. The apparatus of claim 89 wherein the marker is a magnetic marker and the applied field has sufficient magnetic force to cause magnetic changes in said magnetic marker.

94. The apparatus of claim 93 wherein the gain of said amplifier is controlled by a signal which is proportional to the true root-means-square (RMS) value of the detected pulses and noise.

95. The apparatus of claim 93 wherein the gain of said amplifier is controlled by a signal which is proportional to the average absolute value of the detected pulses and noise.

96. The apparatus of claim 93 wherein the gain of said amplifier is controlled by a signal which is proportional to the peak value of the detected pulses and noise.

97. The apparatus of claim 93 and further including means for periodically converting said detected pulses and noise from an analog to a digital representation before signal processing.

98. The apparatus of claim 97 wherein said analog to digital conversion is synchronized with the periodic waveform of the applied field.

99. The apparatus of claim 98 wherein said synchronizing means includes a phase-locked loop.

100. The apparatus of claim 93 wherein said field is alternating and where in said detected pulses and noise are passed through a recirculating delay line integrator with the delay time of the delay line equal to the period of the alternating applied magnetic field.

101. The apparatus of claim 100 wherein said delay line includes a charge coupled device (CCD).

102. The apparatus of claim 100 wherein said recirculating delay line is synchronized to the applied magnetic field.

103. The apparatus of claim 89 wherein the marker is a resonant circuit and the applied electromagnetic field is at a frequency which is swept through a range including the resonant frequency of the marker.

104. The apparatus of claim 103 wherein the gain of said amplifier is controlled by a signal which is proportional to the true root-mean-square (RMS) value of the detected pulses and noise.

105. The apparatus of claim 103 wherein the gain of said amplifier is controlled by a signal which is proportional to the average absolute value of the detected pulses and noise.

106. The apparatus of claim 103 wherein the gain of said amplifier is controlled by a signal which is proportional to the peak value of the detected pulses and noise.

107. The apparatus of claim 103 wherein the gain of said amplifier is controlled by a signal which is proportional to the peak value of the detected pulses and noise and responds rapidly to such peaks but decays slowly to a previously low level, thereby to provide a "fast-attack-slow-decay" response.

108. The apparatus of claim 103 and further including means for periodically converting said detected pulses and noise from an analog to a digital representation before signal processing.

109. The apparatus of claim 108 further including means for synchronizing said analog to digital conversion to the modulation of the swept radio frequency field.

110. The apparatus of claim 109 wherein said means for synchronizing includes a phase-locked loop.

* * * * *

UNITED STATES PATENT AND TRADEMARK OFFICE

CERTIFICATE OF CORRECTION

PATENT NO. : 4,720,701 (Page 1 of 3)

DATED : January 19, 1988

INVENTOR(S) : George J. Lichtblau

It is certified that error appears in the above-identified patent and that said Letters Patent is hereby corrected as shown below:

| | | |
|---|---|---|
| Column 1, | line 40, | "FIG. 1 1A" should read --FIG. 1A-- |
| | line 62, | "case registers," should read --cash registers,-- |
| Column 2, | line 45, | "detcting" should read --detecting-- |
| Column 4, | line 1, | "of the the" should read --of the-- |
| | line 24, | "field field" should read --field-- |
| Column 5, | line 51, | "implulse" should read --impulse-- |
| | lines 54-55, | "attentua- tion" should read --attenua- tion-- |
| | line 62, | "inpulse" should read --impulse-- |
| Column 6, | line 40, | "actuatl" should read --actual-- |
| Column 7, | line 24, | "reprsents" should read --represents-- |
| | line 52, | "porportion" should read --proportion-- |
| Column 8, | line 35, | "converter 100." should read --converter 110.-- |
| | line 47, | "attentuated" should read --attenuated-- |
| | line 48, | "sumemr" should read --summer-- |
| Column 9, | line 19, | "rear time," should read --real time,-- |
| | line 31, | "second, pulse," should read --second pulse,-- |
| | lines 66-67, | "are not" should read --are normally not-- |

UNITED STATES PATENT AND TRADEMARK OFFICE

CERTIFICATE OF CORRECTION

PATENT NO. : 4,720,701 (Page 2 of 3)

DATED : January 19, 1988

INVENTOR(S) : George J. Lichtblau

It is certified that error appears in the above-identified patent and that said Letters Patent is hereby corrected as shown below:

| | | |
|---|---|---|
| Column 10, | line 6, | "change" should read --chance-- |
| | line 11, | "rear world." should read --real world.-- |
| | line 15, | "Ser. No. 680,165," should read --Ser. No. 690,165,-- |
| | line 39, | "Tthe" should read --The-- |
| | line 68, | "is said" should read --if said-- |
| Column 11, | line 47, | "said said" should read --said-- |
| Column 12, | line 17, | "root-means-square" should read --root-mean-square-- |
| | line 30, | "fast-attach-" should read --fast-attack- -- |
| Column 15, | line 12, | ""fast-attach-" should read --"fast-attack- -- |
| | line 52, | "before signal" should read --before further signal-- |
| Column 16, | line 7, | "apparatus claim" should read --apparatus of-- |
| | line 57, | "pulss" should read --pulses-- |
| | line 65, | "adn" should read --and-- |

UNITED STATES PATENT AND TRADEMARK OFFICE

CERTIFICATE OF CORRECTION

PATENT NO. : 4,720,701

DATED : January 19, 1988

INVENTOR(S) : George J. Lichtblau

It is certified that error appears in the above-identified patent and that said Letters Patent is hereby corrected as shown below:

Column 17, line 8, "ot" should read --to-- line 19, "root-means-square" should read --root-mean-square-- line 38, "where in" should read --wherein--

Signed and Sealed this

Thirtieth Day of May, 1989

*Attest:*

*Attesting Officer*

DONALD J. QUIGG

*Commissioner of Patents and Trademarks*